US009242821B2

(12) United States Patent
Watanabe et al.

(10) Patent No.: US 9,242,821 B2
(45) Date of Patent: Jan. 26, 2016

(54) TRANSPORT DEVICE AND IMAGE FORMING APPARATUS

(71) Applicant: FUJI XEROX CO., LTD., Tokyo (JP)

(72) Inventors: Kiyoshi Watanabe, Kanagawa (JP); Naohito Otsuki, Kanagawa (JP); Yoichi Yamakawa, Kanagawa (JP); Mizuki Arai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/257,297

(22) Filed: Apr. 21, 2014

(65) Prior Publication Data

US 2015/0108706 A1 Apr. 23, 2015

(30) Foreign Application Priority Data

Oct. 22, 2013 (JP) ..... 2013-219409

(51) Int. Cl.

| | |
|---|---|
| ***B65H 5/06*** | (2006.01) |
| ***B65H 5/26*** | (2006.01) |
| ***B65H 5/36*** | (2006.01) |
| ***B65H 9/06*** | (2006.01) |
| ***B65H 9/00*** | (2006.01) |

(52) U.S. Cl.

CPC ..... *B65H 5/068* (2013.01); *B65H 5/26* (2013.01); *B65H 5/36* (2013.01); *B65H 9/004* (2013.01); *B65H 9/06* (2013.01); *B65H 2511/11* (2013.01); *B65H 2511/13* (2013.01)

(58) Field of Classification Search

CPC ..... B65H 5/062; B65H 5/068; B65H 9/06; B65H 9/004; B65H 2511/11; B65H 2511/13; B65H 2701/113; B65H 2701/1131; B65H 2701/11312

USPC ..... 271/245, 246, 273

See application file for complete search history.

(56) References Cited

U.S. PATENT DOCUMENTS

| | | | | |
|---|---|---|---|---|
| 5,540,423 | A * | 7/1996 | Nakano | 271/10.12 |
| 2012/0169006 | A1 * | 7/2012 | Matsuda | 271/3.19 |

FOREIGN PATENT DOCUMENTS

| | | |
|---|---|---|
| JP | A-3-195651 | 8/1991 |
| JP | A-7-144796 | 6/1995 |

* cited by examiner

*Primary Examiner* — Michael McCullough
(74) *Attorney, Agent, or Firm* — Oliff PLC

(57) ABSTRACT

A transport device includes an abutting member that abuts a leading end of a transport object and transport members that are disposed upstream of the abutting member in a transport direction and transport the transport object to the abutting member. The transport object is a first or second transport object. One of the transport members or the transport members transport the first transport object and cause the leading end of the first transport object to abut the abutting member. When transporting the transport object to a position where the leading end of the transport object abuts the abutting member, a transport force required to transport the second transport object is larger than that required to transport the first transport object. A larger number of transport members are used to transport the second transport object than the number of the transport members used to transport the first transport object.

8 Claims, 8 Drawing Sheets

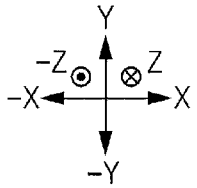
FIG. 3A
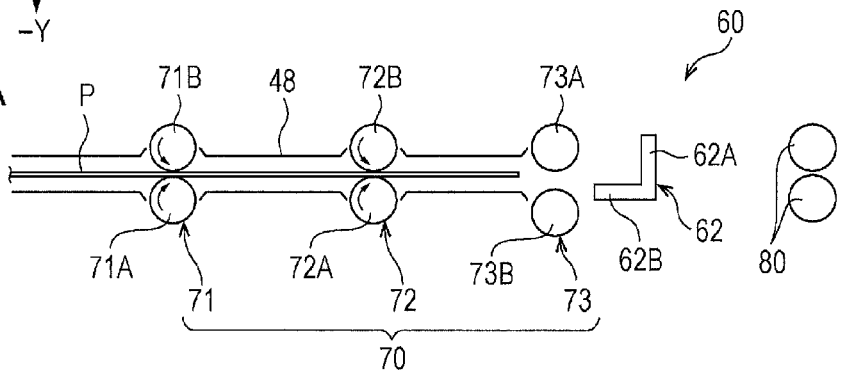
FIG. 3B
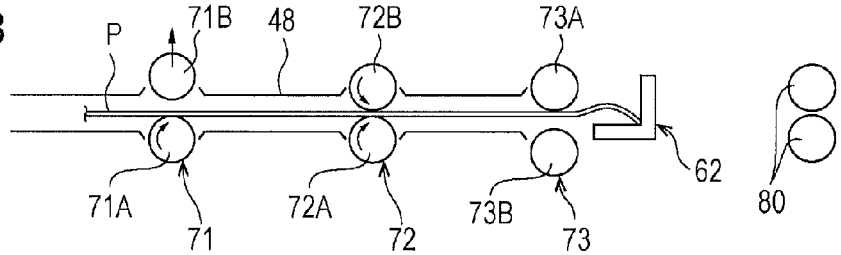
FIG. 3C
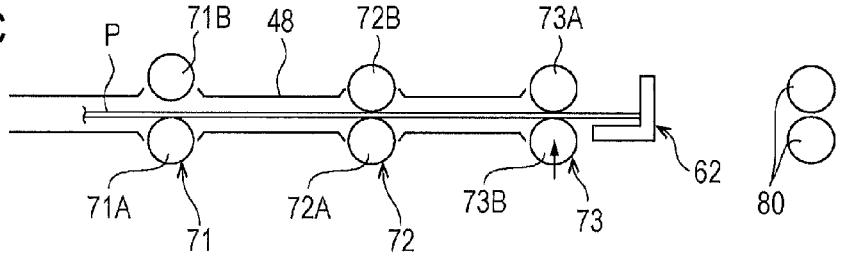
FIG. 3D
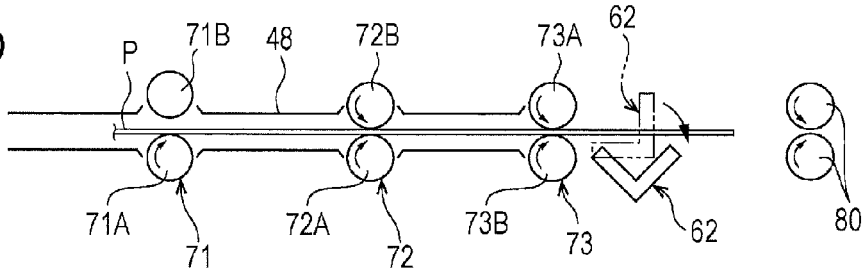

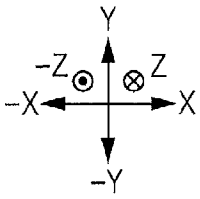
FIG. 4A
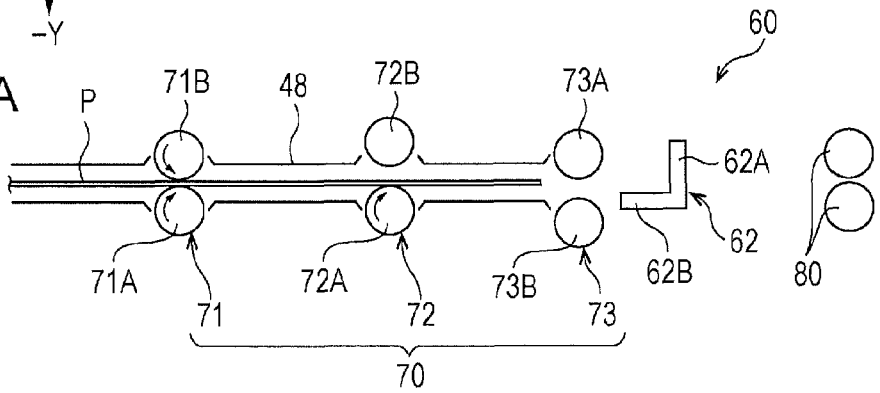
FIG. 4B
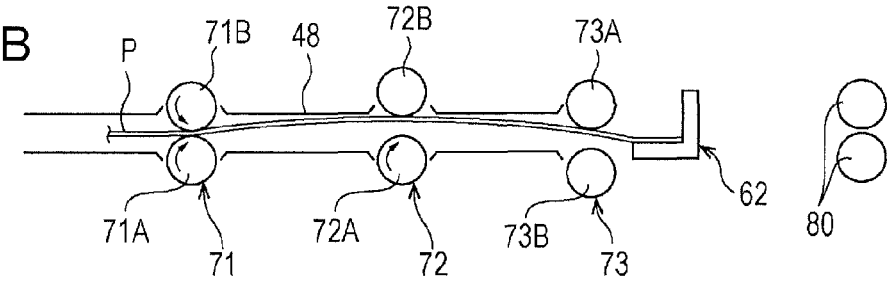
FIG. 4C
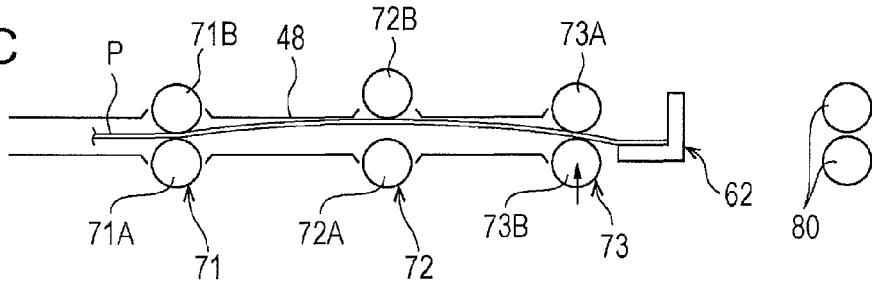
FIG. 4D
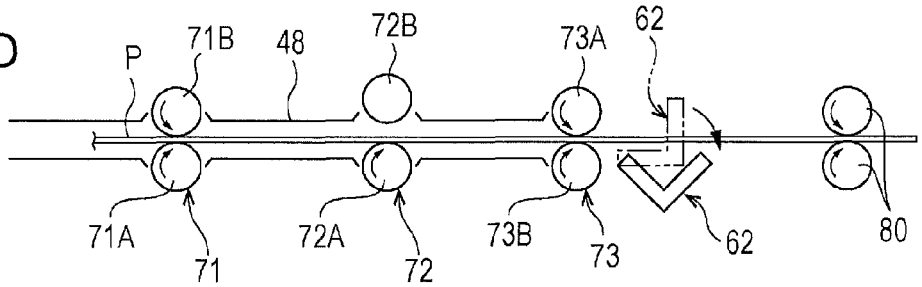

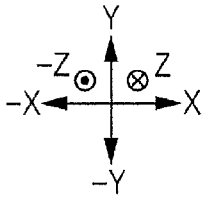
FIG. 5A
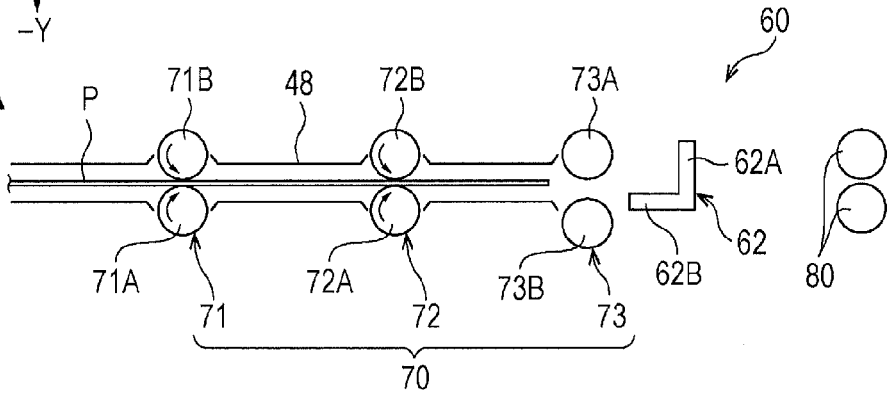
FIG. 5B
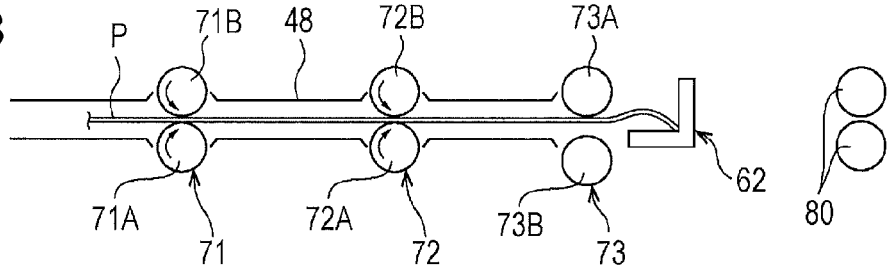
FIG. 5C
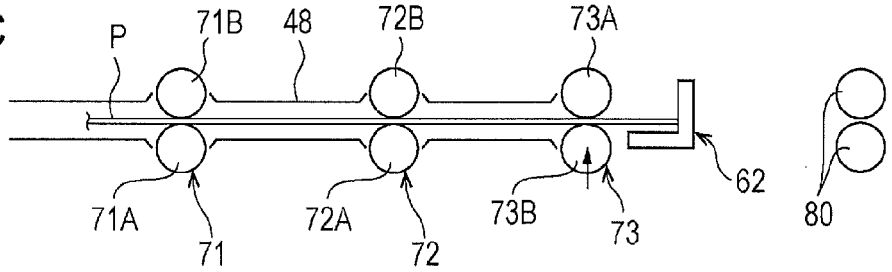
FIG. 5D
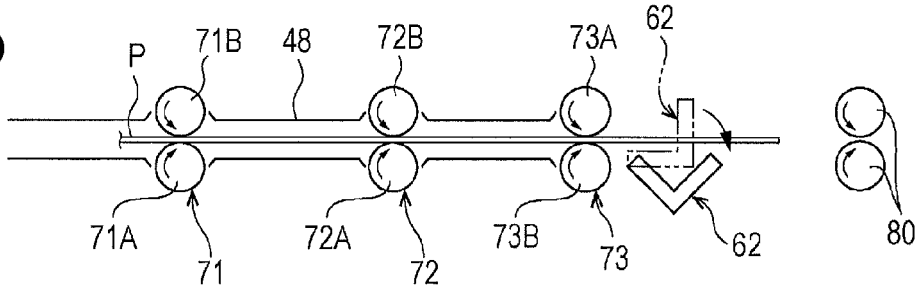

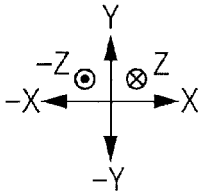
FIG. 6A
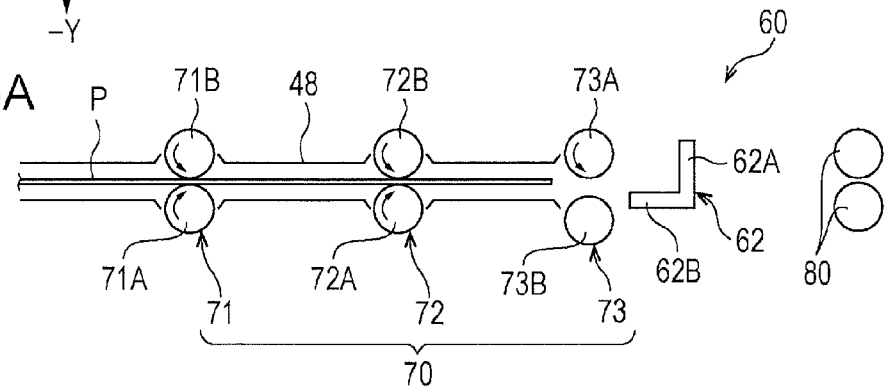
FIG. 6B
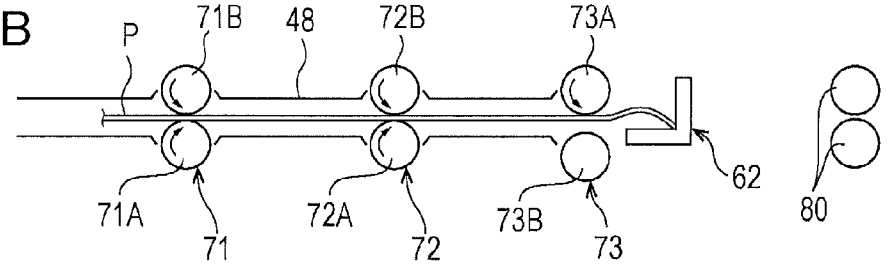
FIG. 6C
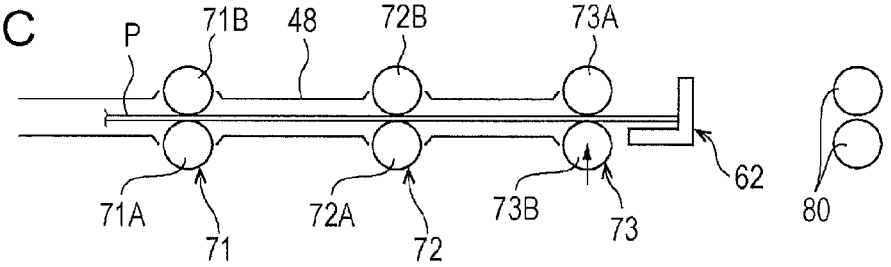
FIG. 6D
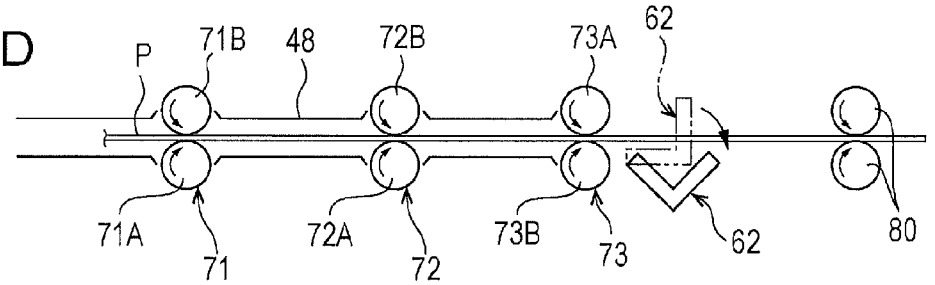

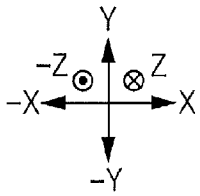
FIG. 7A
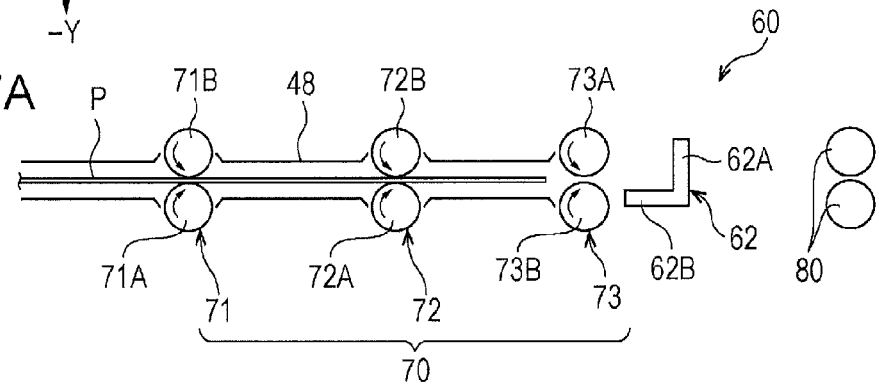
FIG. 7B
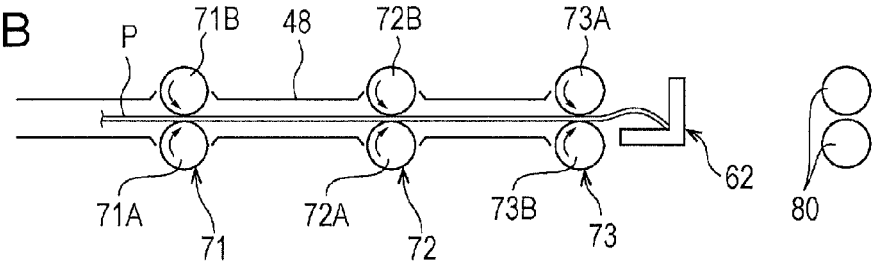
FIG. 7C
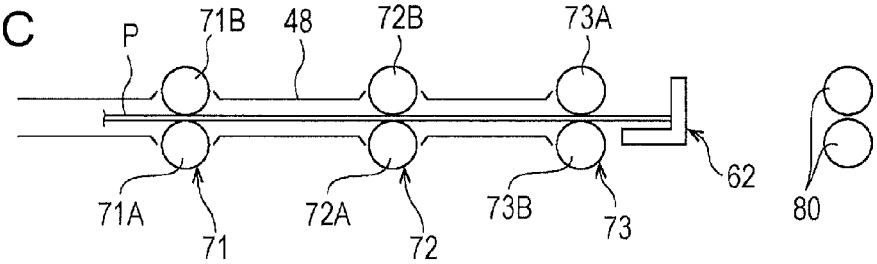
FIG. 7D
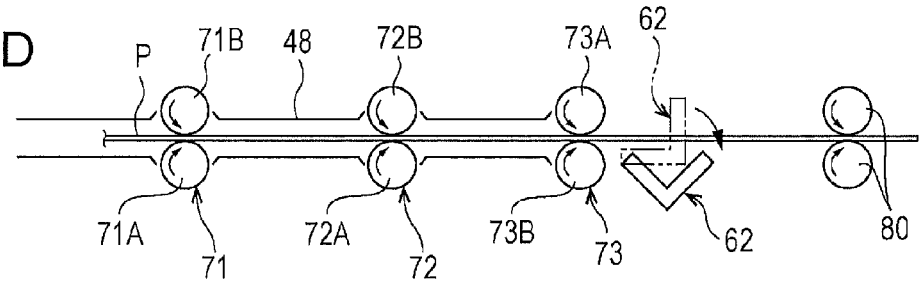

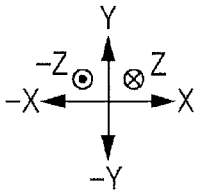
FIG. 8A
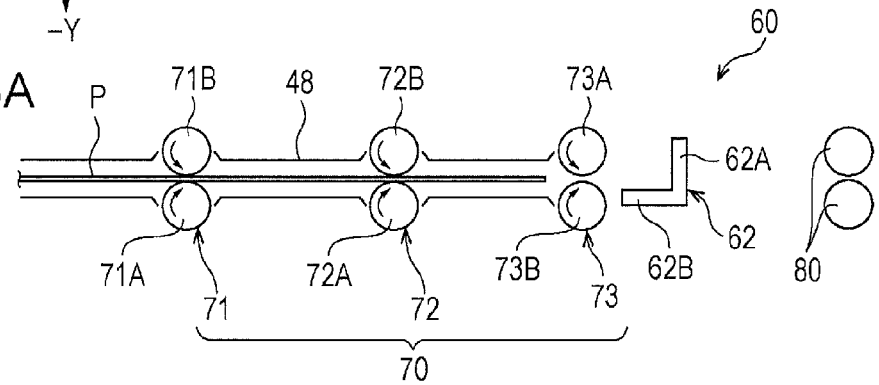
FIG. 8B
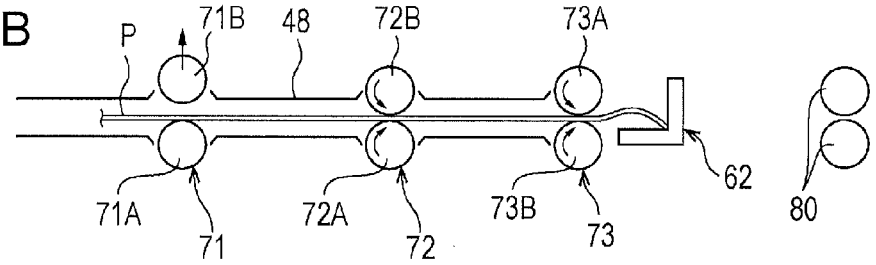
FIG. 8C
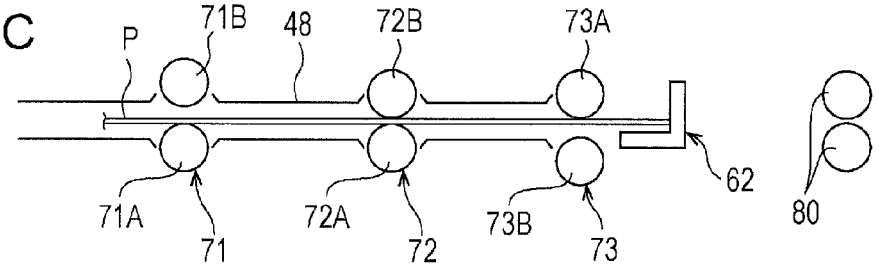
FIG. 8D
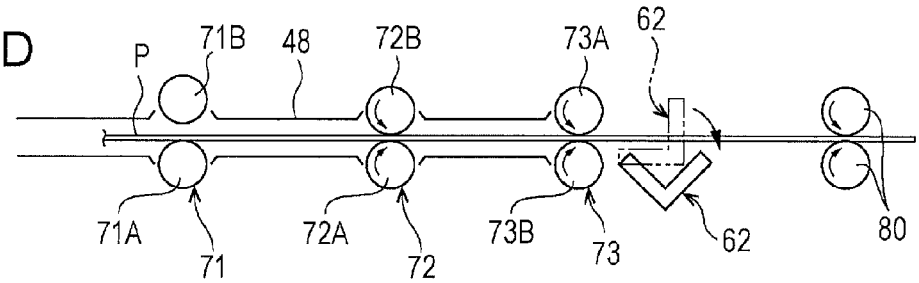

TRANSPORT DEVICE AND IMAGE FORMING APPARATUS

CROSS-REFERENCE TO RELATED APPLICATIONS

This application is based on and claims priority under 35 USC 119 from Japanese Patent Application No. 2013-219409 filed Oct. 22, 2013.

BACKGROUND

Technical Field

The present invention relates to a transport device and an image forming apparatus.

SUMMARY

According to an aspect of the present invention, a transport device that transports a transport object having a leading end includes an abutting member that abuts the leading end of the transport object and plural transport members that are disposed upstream of the abutting member in a transport direction and transport the transport object to the abutting member. In the transport device, the transport object is a first transport object having a leading end or a second transport object having a leading end and surfaces. In the transport device, one of the transport members or the transport members transport the first transport object and cause the leading end of the first transport object to abut the abutting member. In the transport device, when transporting the transport object from the transport members to a position where the transport object abuts the abutting member, a transport force required to transport the second transport object is larger than a transport force required to transport the first transport object. In the transport device, a larger number of transport members are used to transport the second transport object than the number of the transport members used to transport the first transport object.

BRIEF DESCRIPTION OF THE DRAWINGS

Exemplary embodiment of the present invention will be described in detail based on the following figures, wherein:

FIGS. 3A to 3D are side views illustrating a first correction operation in a skew correction mechanism according to the present exemplary embodiment;

FIGS. 4A to 4D are side views illustrating a second correction operation in the skew correction mechanism according to the present exemplary embodiment;

FIGS. 5A to 5D are side views illustrating a third correction operation in the skew correction mechanism according to the present exemplary embodiment;

FIGS. 6A to 6D are side views illustrating a fourth correction operation in the skew correction mechanism according to the present exemplary embodiment;

FIGS. 7A to 7D are side views illustrating a fifth correction operation in the skew correction mechanism according to the present exemplary embodiment; and FIGS. 8A to 8D are side views illustrating a sixth correction operation in the skew correction mechanism according to the present exemplary embodiment.

DETAILED DESCRIPTION

An exemplary embodiment according to the present invention will be described below with reference to the drawings.

Configuration of Image Forming Apparatus 10

Figure 1:
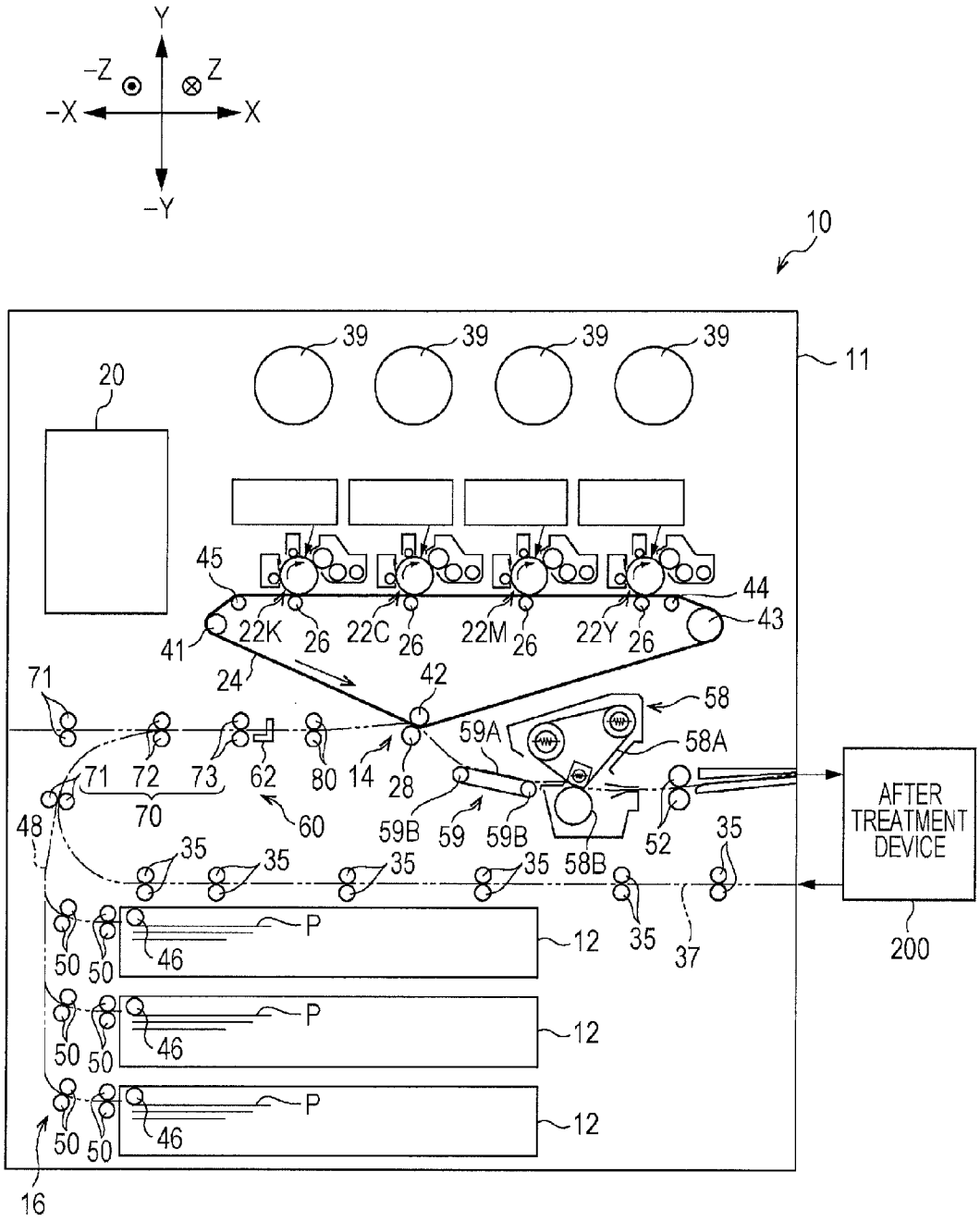
FIG. 1 is a schematic diagram of a configuration of an image forming apparatus according to an exemplary embodiment.

Initially, the configuration of an image forming apparatus 10 according to the present exemplary embodiment is described. FIG. 1 is a schematic diagram of the configuration of the image forming apparatus 10. The X, −X, Y (upper), −Y (lower), Z and −Z directions referred to in the following description are represented by the directions of arrows in the drawings. Also in the drawings, a circular symbol with an "x" therein indicates an arrow that extends from the front to the rear of the pages of the drawings, and a circular symbol with a dot therein indicates an arrow that extends from the rear to the front of the pages of the drawings.

As illustrated in FIG. 1, the image forming apparatus 10 includes an image forming apparatus body 11 (housing) in which components of the image forming apparatus 10 are housed. Plural sheet containers 12, an image forming section 14, a transport device 16, and a controller 20 are disposed in the image forming apparatus body 11. Recording media P (each serving as an example of a transport object) such as sheets of paper are contained in the sheet containers 12. The image forming section 14 forms an image on the recording medium P. The transport device 16 transports the recording media P from the sheet containers 12 to the image forming section 14. The controller 20 controls operations of the components of the image forming apparatus 10.

The image forming section 14 includes image forming units 22Y, 22M, 22C, and 22K (referred to as the image forming units 22Y to 22K hereafter), an intermediate transfer belt 24, first transfer rollers 26, and a second transfer roller 28. The image forming units 22Y to 22K respectively form yellow (Y), magenta (M), cyan (C), and black (K) toner images. The toner images formed by the image forming units 22Y to 22K are transferred onto the intermediate transfer belt 24. The first transfer rollers 26 transfer the toner images formed by the image forming units 22Y to 22K onto the intermediate transfer belt 24. The second transfer roller 28 transfers the toner images, which have been transferred onto the intermediate transfer belt 24 by the first transfer rollers 26, from the intermediate transfer belt 24 onto the recording medium P. The configuration of the image forming section 14 is not limited to the above-described configuration. The image forming section 14 may use any configuration as long as an image is formed on the recording medium P with the configuration.

Figure 2:
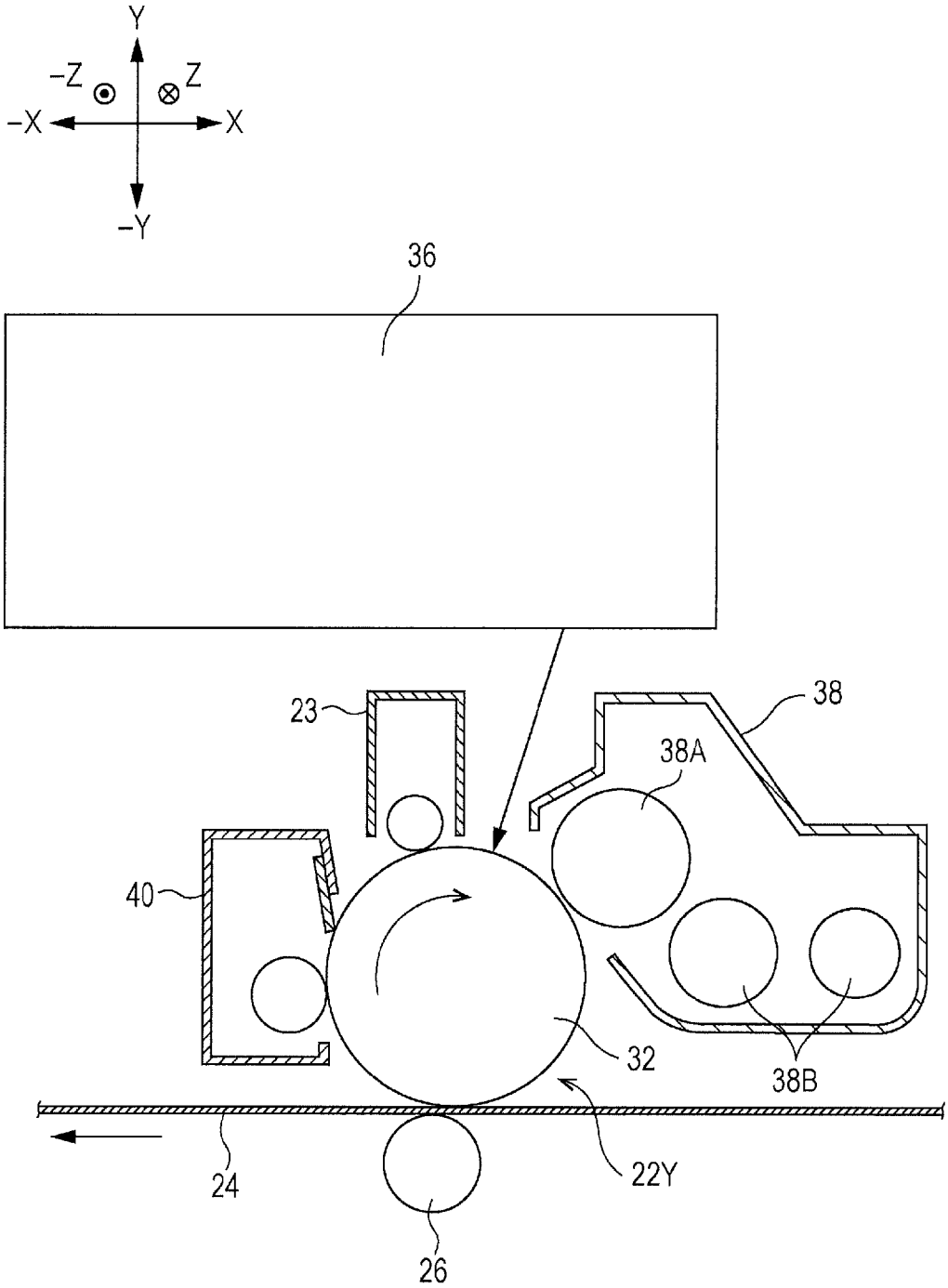
FIG. 2 is a schematic diagram of a configuration of an image forming unit according to the present exemplary embodiment.

The image forming units 22Y to 22K are arranged in the X direction on the Y direction side (upper side) of the intermediate transfer belt 24. As illustrated in FIG. 2, the image forming units 22Y to 22K each include a photoconductor body 32 rotatable in a single direction (for example, clockwise in FIG. 2). Since the image forming units 22Y to 22K are configured similarly to one another, the configuration of the image forming unit 22Y illustrated in FIG. 2 is representative of those of the image forming units 22Y to 22K.

A charger 23, an exposure device 36, a developing device 38, and a cleaning device 40 are provided around the photoconductor body 32 in order from the upstream side in the rotational direction of the photoconductor body 32. The charger 23 causes the photoconductor body 32 to be charged. The photoconductor body 32 having been charged by the charger 23 is exposed to light by the exposure device 36, thereby an electrostatic latent image is formed on the photoconductor body 32. The developing device 38 develops the electrostatic latent image formed on the photoconductor body 32 by using the exposure device 36, thereby forming a toner image. The cleaning device 40 is brought into contact with the photoconductor body 32 so as to remove toner remaining on the photoconductor body 32.

The exposure device 36 forms an electrostatic latent image in accordance with image signals transmitted from the controller 20 (see FIG. 1). Examples of the image signals transmitted from the controller 20 include, for example, an image signal obtained by the controller 20 from an external device.

The developing device 38 includes a developer supply body 38A and plural transport components 38B. The developer supply body 38A supplies developer to the photoconductor body 32. The transport components 38B transport developer to be fed to the developer supply body 38A while agitating the developer.

Referring back to FIG. 1, toner containers 39 are provided above the exposure devices 36. The toner containers 39 contain toner to be supplied to the developing devices 38 of the image forming units 22Y to 22K.

The intermediate transfer belt 24 has an annular shape and is disposed on the −Y direction side (lower side) of the image forming units 22Y to 22K. Stretching rollers 41, 42, 43, 44, and 45, over which the intermediate transfer belt 24 is stretched, are provided on an inner circumferential side of the intermediate transfer belt 24. The intermediate transfer belt 24 is moved in a circulating path (rotated) in a single direction (for example, counterclockwise direction in FIG. 1) by rotating, for example, the stretching roller 43 while being in contact with the photoconductor bodies 32. The stretching roller 42 serves as an opposing roller that opposes the second transfer roller 28.

Each of the first transfer rollers 26 opposes a corresponding one of the photoconductor bodies 32 with the intermediate transfer belt 24 nipped therebetween. A nip between each of the first transfer roller 26 and a corresponding one of the photoconductor bodies 32 is defined as a first transfer position where a toner image formed on the photoconductor body 32 is transferred onto the intermediate transfer belt 24.

The second transfer roller 28 opposes the stretching roller 42 with the intermediate transfer belt 24 nipped therebetween. A nip between the second transfer roller 28 and the stretching roller 42 is defined as a second transfer position where toner images having been transferred onto the intermediate transfer belt 24 are transferred onto the recording medium P.

The transport device 16 includes feeding rollers 46, a transport path 48, and plural transport rollers 50. The feeding rollers 46 feed the recording media P contained in the sheet containers 12. The recording media P fed by the feeding rollers 46 are transported through the transport path 48. The recording media P fed by the feeding rollers 46 are transported toward the second transfer position by the plural transport rollers 50 disposed along the transport path 48. The transport device 16 also includes a skew correction mechanism 60 and registration rollers 80. The skew correction mechanism 60 corrects skew of the recording medium P having been transported thereto by the transport rollers 50. The registration rollers 80 feed the recording medium P, skew of which has been corrected, to the second transfer position. When feeding the recording medium P, the registration rollers 80 adjust timing at which the recording medium P reaches the second transfer position so that the position of an image to be transferred matches the position of the recording medium P. The details of the skew correction mechanism 60 will be described later.

A transport component 59 is provided downstream of the second transfer position in the transport direction. The transport component 59 transports the recording medium P, onto which the toner images have been transferred by the second transfer roller 28. The transport component 59 includes an annular (endless) transport belt 59A and a pair of rollers 59B, over which the transport belt 59A is stretched. By rotating at least one of the pair of rollers 59B while the recording medium P being held on an outer circumferential surface of the transport belt 59A, the recording medium P is transported to a fixing device 58, which will be described later. The recording medium P is, for example, sucked to the transport belt 59A by utilizing plural suction holes formed in the transport belt 59A, thereby the recording medium P is held on the transport belt 59A.

The fixing device 58 is provided downstream of the transport component 59 in the transport direction. The toner images having been transferred onto the recording medium P by the second transfer roller 28 are fixed onto the recording medium P by the fixing device 58. In the fixing device 58, the toner images are fixed onto the recording medium P, which has been transported from the transport component 59, by heat applied by a fixing belt 58A and pressure applied by a pressure roller 58B.

Ejection rollers 52 are provided downstream of the fixing device 58 in the transport direction. The recording medium P, onto which the toner images have been fixed, is ejected from the image forming apparatus body 11 to an after treatment device 200. The after treatment device 200 includes components such as, for example, a cooling unit (not shown), a correction unit (not shown), an inspection unit (not shown), and an output unit (not shown). The cooling unit cools the recording medium P. The correction unit corrects bending of the recording medium P. The inspection unit inspects an image formed on the recording medium P. The recording medium P is ejected to the output unit.

Furthermore, a transport path 37 is disposed at a position, which is below the fixing device 58 and above the sheet containers 12. The recording medium P, onto one side of which the toner images have been fixed, is returned to the second transfer position through the transport path 37. The recording medium P having been ejected to the after treatment device 200 by the ejection rollers 52 is inverted by the after treatment device 200 and fed to the transport path 37. The recording medium P having been fed to the transport path 37 is transported to the skew correction mechanism 60 by plural transport roller pairs 35 disposed along the transport path 37. Skew of the recording medium P having been transported to the skew correction mechanism 60 is corrected by the skew correction mechanism 60. Then, the recording medium P is fed to the second transfer position by the registration rollers 80.

Image Forming Operation

Next, image forming operations performed by the image forming apparatus 10 according to the present exemplary embodiment are described. An image is formed on the recording medium P through the image forming operations.

In the image forming apparatus 10 according to the present exemplary embodiment, the recording media P having been fed from the sheet containers 12 by the feeding rollers 46 are transported by the plural transport rollers 50. Skew of each of the recording media P having been transported by the plural transport rollers 50 is corrected by the skew correction mechanism 60. Then, the recording medium P is fed to the second transfer position by the registration rollers 80.

In each of the image forming units 22Y to 22K, the photoconductor body 32 charged by the charger 23 is exposed to light by the exposure device 36, thereby forming an electrostatic latent image on the photoconductor body 32. This electrostatic latent image is developed by the developing device 38, thereby a toner image is formed on the photoconductor body 32. The toner images of the colors formed by the image forming units 22Y to 22K are superposed with one another on the intermediate transfer belt 24 at the respective first transfer positions. Thus, a color image has been formed. The color image formed on the intermediate transfer belt 24 is transferred onto the recording medium P at the second transfer position.

The recording medium P, onto which the toner images have been transferred, is transported to the fixing device 58 by the transport component 59. The toner images having been transferred are fixed onto the recording medium P by the fixing device 58. The recording medium P, onto which the toner images have been fixed, is ejected from the image forming apparatus body 11 to the after treatment device 200 by the ejection rollers 52. Thus, a series of the image forming operations are performed.

Skew Correction Mechanism 60

Next, a configuration of the skew correction mechanism 60 is described. FIGS. 3A to 7D are side views of the configuration of the skew correction mechanism 60. Although the transport path 48 is illustrated in a linear shape in FIGS. 3A to 7D, the transport path 48 actually has a partially curved shape.

As illustrated in FIG. 3A, the skew correction mechanism 60 includes abutting members 62 and a transport mechanism 70. A leading end of the recording medium P is brought into abutment with the abutting members 62. The transport mechanism 70, which is disposed upstream of the abutting members 62 in the transport direction, transports the recording medium P to the abutting members 62.

Each of the abutting members 62 has an abutting portion 62A and a bottom portion 62B. The abutting portion 62A extends in the Y direction (upper and lower direction) in side view (seen in the Z direction). The leading end of the recording medium P is brought into abutment with the abutting portion 62A. The bottom portion 62B extends in the X direction (transport direction) in side view (seen in the Z direction). The abutting member 62 having such an abutting portion 62A and a bottom portion 62B has an L-shape in side view (seen in the Z direction).

The plural abutting members 62 are arranged in the Z direction and abut the leading end of the recording medium P from one to the other side ends of the recording medium P. The abutting members 62 are each swingably supported by the image forming apparatus body 11 (see FIG. 1) about a swing axis near a leading end portion (end portion on the −X direction side) of the bottom portion 62B. Specifically, as illustrated in FIG. 3D, the abutting members 62 are each swingable between an abutting position (represented by two-dot chain lines) and a retracted position (represented by solid lines). The abutting portion 62A at the abutting position is positioned in the transport path. The abutting portion 62A is moved away from the transport path to the retracted position.

As illustrated in FIG. 3A, the transport mechanism 70 includes the following roller pairs that transport the recording medium P: a first transport roller pair 71 (an example of a first transport member), a second transport roller pair 72 (an example of a second transport member), and a third transport roller pair 73 (an example of a third transport member). The first transport roller pair 71, the second transport roller pair 72, and the third transport roller pair 73 are arranged in this order from the upstream side to the downstream side in the transport direction.

The first transport roller pair 71 includes a drive roller 71A disposed on the −Y direction side (lower side) and a driven roller 71B disposed on the Y direction side (upper side). The drive roller 71A is rotated clockwise in FIGS. 3A to 3D by a drive unit (not shown). The drive roller 71A uses, for example, a rubber roller having an outer circumferential portion formed of rubber.

The driven roller 71B is supported by the image forming apparatus body 11 such that the driven roller 71B is movable relative to the image forming apparatus body 11 between a contact position (position illustrated in FIG. 3A) and a separated position (position illustrated in FIG. 3B). The driven roller 71B at the contact position is in contact with the drive roller 71A. The driven roller 71B at the separated position is separated from the drive roller 71A. The driven roller 71B is urged from the separated position toward the contact position by an urging member (not shown) such as, for example, a spring. The driven roller 71B is moved from the contact position to the separated position by, for example, an operation of a cam (not shown), the operation causing the driven roller 71B to resist the urging force of the urging member (not shown).

The driven roller 71B at the contact position is driven to rotate counterclockwise in FIGS. 3A to 3D by the rotation of the drive roller 71A. Thus, the drive roller 71A and the driven roller 71B transport the recording medium P while nipping the recording medium P therebetween. The driven roller 71B uses, for example, a resin roller, at least an outer circumferential portion of which is formed of resin.

The second transport roller pair 72 includes a drive roller 72A disposed on the −Y direction side (lower side) and a driven roller 72B disposed on the Y direction side (upper side). The drive roller 72A is rotated clockwise in FIGS. 3A to 3D by a drive unit (not shown).

The driven roller 72B is supported by the image forming apparatus body 11 such that the driven roller 72B is movable relative to the image forming apparatus body 11 between a contact position (position illustrated in FIG. 3A) and a separated position (position illustrated in FIG. 4A). The driven roller 72B at the contact position is in contact with the drive roller 72A. The driven roller 72B at the separated position is separated from the drive roller 72A. The driven roller 72B is moved between the contact position and the separated position by, for example, a motor (drive unit).

The driven roller 72B at the contact position is driven to rotate counterclockwise in FIGS. 3A to 3D by the rotation of the drive roller 72A. Thus, the drive roller 72A and the driven roller 72B transport the recording medium P while nipping the recording medium P therebetween.

The driven roller 72B uses, for example, a resin roller, at least an outer circumferential portion of which is formed of resin. The drive roller 72A uses, for example, a rubber roller having an outer circumferential portion formed of a rubber, the hardness of which is higher than that of the rubber portion of the drive roller 71A. Thus, the coefficient of friction of the second transport roller pair 72 against the recording medium P is lower than that of the first transport roller pair 71 against the recording medium P. Accordingly, the recording medium P easily slips on the second transport roller pair 72 than on the first transport roller pair 71.

The third transport roller pair 73 includes a drive roller 73A disposed on the Y direction side (upper side) and a driven roller 73B disposed on the −Y direction side (lower side). The drive roller 73A is rotated counterclockwise in FIGS. 3A to 3D by a drive unit (not shown). The drive roller 73A uses, for example, a rubber roller having an outer circumferential portion formed of rubber.

The driven roller 73B is supported by the image forming apparatus body 11 such that the driven roller 73B is movable relative to the image forming apparatus body 11 between a contact position (position illustrated in FIG. 3C) and a separated position (position illustrated in FIG. 3A). The driven roller 73B at the contact position is in contact with the drive roller 73A. The driven roller 73B at the separated position is separated from the drive roller 73A. The driven roller 73B is urged from the separated position toward the contact position by an urging member (not shown) such as a spring. The driven roller 73B is moved from the contact position to the separated position by an operation of a cam (not shown), the operation causing the driven roller 73B to resist the urging force of the urging member (not shown).

The driven roller 73B at the contact position is driven to rotate clockwise in FIGS. 3A to 3D by the rotation of the drive roller 73A. Thus, the drive roller 73A and the driven roller 73B transport the recording medium P while nipping the recording medium P therebetween. The driven roller 73B uses, for example, a resin roller, at least an outer circumferential portion of which is formed of resin.

The abutting members 62, the first transport roller pair 71, the second transport roller pair 72, and the third transport roller pair 73 of the skew correction mechanism 60 are controlled by the controller 20 so as to perform correction operations as follows.

Correction Operations in Skew Correction Mechanism 60

In order to correct skew of a thin sheet of paper as the recording medium P transported only through the transport path 48, for example, the following first correction operation is performed in the skew correction mechanism 60. In order to correct skew of a thin sheet of paper as the recording medium P transported through the transport path 37, for example, the following second correction operation is performed in the skew correction mechanism 60. In order to correct skew of a thick sheet of paper as the recording medium P regardless of which transport paths the thick sheet is transported through, for example, the following third correction operation is performed in the skew correction mechanism 60.

Here, the curvature of the transport path 37 is larger than that of the transport path 48, and accordingly, transport resistance against the recording medium P is larger in the transport path 37 than in the transport path 48. Thus, a transport force, which is required to transport a sheet from the transport mechanism 70 to a position where the leading end of the thin sheet abuts the abutting members 62, is larger for the thin sheet transported through the transport path 37 than for the thin sheet transported through the transport path 48.

Furthermore, since the stiffness of the thick sheet is larger than that of the thin sheet, the transport force, which is required to transport a sheet from the transport mechanism 70 to a position where the leading end of the sheet abuts the abutting members 62, is larger for the thick sheet than for the thin sheet regardless of which transport paths the sheet is transported through.

Accordingly, the transport force, which is required to transport a sheet from the transport mechanism 70 to the position where the leading end of the sheet abuts the abutting members 62, is set to different values for the above-described sheets in the following order from the smallest to the largest: the thin sheet transported only through the transport path 48, the thin sheet transported through the transport path 37, and the thick sheet.

First Correction Operation

As illustrated in FIG. 3A, initially in the first correction operation, the driven roller 71B of the first transport roller pair 71 is positioned at the contact position and the drive roller 71A of the first transport roller pair 71 is rotated. In the second transport roller pair 72, the driven roller 72B is positioned at the contact position and the drive roller 72A is rotated. At this time, in the third transport roller pair 73, the driven roller 73B is positioned at the separated position and rotation of the drive roller 73A is stopped.

Thus, the first and second transport roller pairs 71 and 72 in a nipping state transport the recording medium P toward the abutting members 62.

Before the leading end of the recording medium P having passed through the second transport roller pair 72 abuts the abutting members 62, in the first transport roller pair 71, the driven roller 71B is moved to the separated position while rotation of the drive roller 71A is maintained as illustrated in FIG. 3B. Thus, the drive roller 71A of the first transport roller pair 71 in a non-nipping state and the second transport roller pair 72 in the nipping state transport the recording medium P to the abutting members 62 and cause the leading end of the recording medium P to abut the abutting members 62. The drive roller 71A of the first transport roller pair 71 in the non-nipping state and the second transport roller pair 72 in the nipping state cause the leading end of the recording medium P to abut the abutting members 62 for a predetermined time period, and then the rotation is stopped. By causing the leading end of the recording medium P to abut the abutting members 62 for the predetermined time period, the orientation of the leading end of the recording medium P is corrected so as to be in a direction along the abutting members 62, and accordingly, skew of the recording medium P is corrected.

In order to cause the leading end of the recording medium P to abut the abutting members 62, the rotation of the drive roller 71A may be stopped and the recording medium P may be transported to the abutting members 62 only by the second transport roller pair 72 so that the leading end of the recording medium P abuts the abutting members 62.

Next, as illustrated in FIG. 3C, the driven roller 73B of the third transport roller pair 73 is moved to the contact position so as to set the third transport roller pair 73 in the nipping state.

Next, as illustrated in FIG. 3D, the abutting members 62 are moved to the respective retracted positions. After that, the drive roller 71A of the first transport roller pair 71 in the non-nipping state, the second transport roller pair 72 in the nipping state, and the third transport roller pair 73 in the nipping state transport the recording medium P to the registration rollers 80.

Second Correction Operation

As illustrated in FIG. 4A, initially in the second correction operation, the driven roller 71B of the first transport roller pair 71 is positioned at the contact position and the drive roller 71A of the first transport roller pair 71 is rotated. In the second transport roller pair 72, the driven roller 72B is positioned at the separated position and the drive roller 72A is rotated. In the third transport roller pair 73, the driven roller 73B is positioned at the separated position and rotation of the drive roller 73A is stopped.

Thus, the first transport roller pair 71 in the nipping state and the drive roller 72A of the second transport roller pair 72 in the non-nipping state transport the recording medium P toward the abutting members 62.

As illustrated in FIG. 4B, the first transport roller pair 71 in the nipping state and the drive roller 72A of the second transport roller pair 72 in the non-nipping state further transport the recording medium P to the abutting members 62 so as to cause the leading end of the recording medium P to abut the abutting members 62. Since the coefficient of friction of the first transport roller pair 71 is larger than that of the second transport roller pair 72, in the second correction operation, the recording medium P is transported and the leading end of the recording medium P is caused to abut the abutting members 62 by the transport force larger than that in the first correction operation.

The first transport roller pair 71 in the nipping state and the drive roller 72A of the second transport roller pair 72 in the non-nipping state cause the leading end of the recording medium P to abut the abutting members 62 for a predetermined time period, and then the rotation is stopped. By causing the leading end of the recording medium P to abut the abutting members 62 for the predetermined time period, the orientation of the leading end of the recording medium P is corrected so as to be in a direction along the abutting members 62, and accordingly, skew of the recording medium P is corrected.

Next, as illustrated in FIG. 4C, the driven roller 73B of the third transport roller pair 73 is moved to the contact position so as to set the third transport roller pair 73 in the nipping state. The second transport roller pair 72 is maintained in the non-nipping state.

Next, as illustrated in FIG. 4D, the abutting members 62 are moved to the respective retracted positions. After that, the first transport roller pair 71 in the nipping state, the drive roller 72A of the second transport roller pair 72 in the non-nipping state, and the third transport roller pair 73 in the nipping state transport the recording medium P to the registration rollers 80.

Third Correction Operation

As illustrated in FIG. 5A, initially in the third correction operation, the driven roller 71B of the first transport roller pair 71 is positioned at the contact position and the drive roller 71A of the first transport roller pair 71 is rotated. In the second transport roller pair 72, the driven roller 72B is positioned at the contact position and the drive roller 72A is rotated. At this time, in the third transport roller pair 73, the driven roller 73B is positioned at the separated position and rotation of the drive roller 73A is stopped.

Thus, the first and second transport roller pairs 71 and 72 in the nipping state transport the recording medium P toward the abutting members 62.

As illustrated in FIG. 5B, the first and second transport roller pairs 71 and 72 in the nipping state further transport the recording medium P to the abutting members 62 so as to cause the leading end of the recording medium P to abut the abutting members 62. In the third correction operation, the number of transport roller pairs that transport the recording medium P while being set in the nipping state is larger than that in the first correction operation and larger than that in the second correction operation. Thus, in the third correction operation, the recording medium P is transported and the leading end of the recording medium P is caused to abut the abutting members 62 by the transport force larger than that in the first correction operation and larger than that in the second correction operation.

The first and second transport roller pairs 71 and 72 in the nipping state cause the leading end of the recording medium P to abut the abutting members 62 for a predetermined time period, and then the rotation is stopped. By causing the leading end of the recording medium P to abut the abutting members 62 for the predetermined time period, the orientation of the leading end of the recording medium P is corrected so as to be in a direction along the abutting members 62, and accordingly, skew of the recording medium P is corrected.

Next, as illustrated in FIG. 5C, the driven roller 73B of the third transport roller pair 73 is moved to the contact position so as to set the third transport roller pair 73 in the nipping state.

Next, as illustrated in FIG. 5D, the abutting members 62 are moved to the respective retracted positions. After that, with the first, second, and third transport roller pairs 71, 72, and 73 set in the nipping state, the drive rollers 71A, 72A, and 73A are rotated so as to transport the recording medium P to the registration rollers 80.

As described above, in the third correction operation, the number of transport roller pairs that transport the recording medium P while being set in the nipping state is larger than that in the first correction operation and larger than that in the second correction operation. Thus, in the third correction operation, the recording medium P is transported and the leading end of the recording medium P is caused to abut the abutting members 62 by the transport force larger than that in the first correction operation and larger than that in the second correction operation.

Thus, the transport force for transportation of the recording medium P is set to different values in the following order from the smallest to the largest: the first correction operation, the second correction operation, and the third correction operation.

As described above, in the configuration according to the present exemplary embodiment, the first correction operation is performed on the thin sheet transported only through the transport path 48 so that the skew of the thin sheet is corrected. The second correction operation, in which the transport force is larger than that in the first correction operation, is performed on the thin sheet transported through the transport path 37 so that skew of the thin sheet is corrected. Furthermore, the third correction operation, in which the transport force is larger than that in the first correction operation and larger than that in the second correction operation, is performed on the thick sheet so that skew of the thick sheet is corrected.

That is, in the present exemplary embodiment, when a large transport force is required to transport the recording medium P (the thin sheet transported through the transport path 37 or the thick sheet) from the transport mechanism 70 to a position where the leading end of the recording medium P abuts the abutting members 62, a large transport force is accordingly applied to the recording medium P so as to transport the recording medium P and cause the leading end of the recording medium P to abut the abutting members 62, thereby correcting skew of the recording medium P.

Thus, even when a large transport force is required to transport the recording medium P to the position where the recording medium P abuts the abutting members 62, the recording medium P effectively abuts the abutting members 62, and accordingly, skew of the recording medium P is corrected.

In contrast, when a small transport force is required to transport the recording medium P (the thin sheet transported only through the transport path 48) to the position where the recording medium P abuts the abutting members 62, the force with which the recording medium P abuts the abutting members 62 is not unnecessarily increased. This suppresses buckling of the leading end of the recording medium P. Thus, regardless of whether the transport force required to transport the recording medium P to the position where the recording medium P abuts the abutting members 62 is large or small, skew is appropriately corrected.

Furthermore, in the present exemplary embodiment, the first transport roller pair 71 is used to transport the recording medium P in the second correction operation. Since the coefficient of friction of the first transport roller pair 71 is larger than that of the second transport roller pair 72 used in the first correction operation, the transport force for transportation of the recording medium P is effectively increased.

Furthermore, in the present exemplary embodiment, the first transport roller pair 71 transports the recording medium P in the second correction operation. The first transport roller pair 71 is disposed upstream of the second transport roller pair 72, which is used in the first correction operation, in the transport direction. Thus, compared to the case where the first transport roller pair 71 is not used, the leading end side of the recording medium P is unlikely to be restrained by the transport roller pair. This increases the degree of freedom on the leading end side of the recording medium P, and accordingly, the leading end of the recording medium P is easily aligned with the abutting members 62. Thus, skew of the recording medium P is effectively corrected.

Furthermore, in the present exemplary embodiment, the number of transport roller pairs that transport the recording medium P while being set in the nipping state in the third correction operation is larger than that in the first correction operation and larger than that in the second correction operation. Thus, the transport force for transportation of the recording medium P is easily and effectively increased.

Furthermore, in the present exemplary embodiment, the first transport roller pair 71 transports the recording medium P in the third correction operation. The first transport roller pair 71 is disposed upstream of the second transport roller pair 72, which is used in the first correction operation, in the transport direction. Thus, compared to the case where the first transport roller pair 71 is not used (for example, the case where the second and third transport roller pairs 72 and 73 transport the recording medium P), the leading end side of the recording medium P is unlikely to be restrained by the transport roller pair. This increases the degree of freedom on the leading end side of the recording medium P, and accordingly, the leading end of the recording medium P is easily aligned with the abutting members 62. Thus, skew of the recording medium P is effectively corrected.

As described above, skew of the recording medium P is corrected in the present exemplary embodiment. This suppresses shift in orientation (position) of an image formed on the recording medium P relative to the recording medium P.

Variants

As the correction operations of the components of the skew correction mechanism 60, there are, for example, the following fourth, fifth, and sixth correction operations other than the first to third correction operations.

Fourth Correction Operation

As illustrated in FIG. 6A, initially in the fourth correction operation, the driven roller 71B of the first transport roller pair 71 is positioned at the contact position and the drive roller 71A of the first transport roller pair 71 is rotated. In the second transport roller pair 72, the driven roller 72B is positioned at the contact position and the drive roller 72A is rotated. At this time, in the third transport roller pair 73, the driven roller 73B is positioned at the separated position and the drive roller 73A is being rotated.

Thus, the first and second transport roller pairs 71 and 72 in the nipping state and the drive roller 73A of the third transport roller pair 73 in the non-nipping state transport the recording medium P toward the abutting members 62.

As illustrated in FIG. 6B, the first and second transport roller pairs 71 and 72 in the nipping state and the drive roller 73A of the third transport roller pair 73 in the non-nipping state further transport the recording medium P to the abutting members 62 so as to cause the leading end of the recording medium P to abut the abutting members 62. The first and second transport roller pairs 71 and 72 in the nipping state and the drive roller 73A of the third transport roller pair 73 in the non-nipping state cause the leading end of the recording medium P to abut the abutting members 62 for a predetermined time period, and then the rotation is stopped. By causing the leading end of the recording medium P to abut the abutting members 62 for the predetermined time period, the orientation of the leading end of the recording medium P is corrected so as to be in a direction along the abutting members 62, and accordingly, skew of the recording medium P is corrected.

Next, as illustrated in FIG. 6C, the driven roller 73B of the third transport roller pair 73 is moved to the contact position so as to set the third transport roller pair 73 in the nipping state.

Next, as illustrated in FIG. 6D, the abutting members 62 are moved to the respective retracted positions. After that, with the first, second, and third transport roller pairs 71, 72, and 73 set in the nipping state, the drive rollers 71A, 72A, and 73A are rotated so as to transport the recording medium P to the registration rollers 80.

In the fourth correction operation, in addition to the first and second transport roller pairs 71 and 72 in the nipping state, the drive roller 73A of the third transport roller pair 73 in the non-nipping state is used to transport the recording medium P. Thus, the recording medium P is transported by the transport force larger than that in the third correction operation so as to cause the leading end of the recording medium P to abut the abutting members 62. Thus, the transport force for transportation of the recording medium P is increased while the degree of freedom on the leading end side of the recording medium P is maintained.

Fifth Correction Operation

As illustrated in FIG. 7A, initially in the fifth correction operation, the driven roller 71B of the first transport roller pair 71 is positioned at the contact position and the drive roller 71A of the first transport roller pair 71 is rotated. In the second transport roller pair 72, the driven roller 72B is positioned at the contact position and the drive roller 72A is rotated. In the third transport roller pair 73, the driven roller 73B is positioned at the contact position and the drive roller 73A is rotated.

Thus, the first and second transport roller pairs 71 and 72 in the nipping state and the drive roller 73A of the third transport roller pair 73 in the nipping state transport the recording medium P toward the abutting members 62.

As illustrated in FIG. 7B, the first, second, and third transport roller pairs 71, 72, and 73 in the nipping state further transport the recording medium P to the abutting members 62 so as to cause the leading end of the recording medium P to abut the abutting members 62.

Next, as illustrated in FIG. 7C, the first, second, and third transport roller pairs 71, 72 and 73 in the nipping state cause the leading end of the recording medium P to abut the abutting members 62 for a predetermined time period, and then the rotation is stopped. By causing the leading end of the recording medium P to abut the abutting members 62 for the predetermined time period, the orientation of the leading end of the recording medium P is corrected so as to be in a direction along the abutting members 62, and accordingly, skew of the recording medium P is corrected.

Next, as illustrated in FIG. 7D, the abutting members 62 are moved to the respective retracted positions. After that, with the first, second, and third transport roller pairs 71, 72, and 73 set in the nipping state, the drive rollers 71A, 72A, and 73A are rotated so as to transport the recording medium P to the registration rollers 80.

In the fifth correction operation, in addition to the first and second transport roller pairs 71 and 72, the third transport roller pair 73 also set in the nipping state is used to transport the recording medium P. Thus, the recording medium P is transported by the transport force larger than that in the fourth correction operation so as to cause the leading end of the recording medium P to abut the abutting members 62.

Sixth Correction Operation

As illustrated in FIG. 8A, initially in the sixth correction operation, the driven roller 71B of the first transport roller pair 71 is positioned at the contact position and the drive roller 71A of the first transport roller pair 71 is rotated. In the second transport roller pair 72, the driven roller 72B is positioned at the contact position and the drive roller 72A is rotated. In the third transport roller pair 73, the driven roller 73B is positioned at the contact position and the drive roller 73A is rotated.

Thus, the first and second transport roller pairs 71 and 72 in the nipping state and the drive roller 73A of the third transport roller pair 73 in the nipping state transport the recording medium P toward the abutting members 62.

Before the leading end of the recording medium P having passed through the second transport roller pair 72 abuts the abutting members 62, in the first transport roller pair 71, the driven roller 71B is moved to the separated position while rotation of the drive roller 71A is stopped as illustrated in FIG. 8B. Thus, the recording medium P is transported to the abutting members 62 by the second and third transport roller pairs 72 and 73 in the nipping state so as to cause the leading end of the recording medium P to abut the abutting members 62.

When the second and third transport roller pairs 72 and 73 in the nipping state cause the leading end of the recording medium P to abut the abutting members 62 for a predetermined time period, as illustrated in FIG. 8C, the driven roller 73B is moved to the separated position so as to set the third transport roller pair 73 in the non-nipping state, and rotation of the second transport roller pair 72 and the third transport roller pair 73 is stopped. By causing the leading end of the recording medium P to abut the abutting members 62 for the predetermined time period, the orientation of the leading end of the recording medium P is corrected so as to be in a direction along the abutting members 62, and accordingly, skew of the recording medium P is corrected. By setting the third transport roller pair 73 in the non-nipping state, the degree of freedom of the recording medium P on the leading end side is maintained.

Next, as illustrated in FIG. 8D, the abutting members 62 are moved to the respective retracted positions. After that, the driven roller 73B is moved to the contact position. With the first, second, and third transport roller pairs 71, 72, and 73 set in the nipping state, the drive rollers 71A, 72A, and 73A are rotated so as to transport the recording medium P to the registration rollers 80.

In the sixth correction operation, the second and third transport roller pairs 72 and 73 in the nipping state transport the recording medium P. Thus, the recording medium P is transported by the transport force that is larger than at least that in the second correction operation and smaller than that in the fifth correction operation so as to cause the leading end of the recording medium P to abut the abutting members 62.

Thus, the transport force for transportation of the recording medium P is set to different values in the following order from the smallest to the largest: the first correction operation, the second correction operation, the third correction operation, the fourth correction operation, and the fifth correction operation. The transport force in the sixth correction operation is larger than at least that in the second correction operation and smaller than that in the fifth correction operation. A correction operation other than the first to sixth correction operations may be used to correct skew of the recording medium P.

In the aforementioned exemplary embodiment, the first correction operation is applied to the thin sheet transported only through the transport path 48. However, out of the first to fifth correction operations, for example, the second or third correction operation may be applied to the thin sheet transported only through the transport path 48.

In the aforementioned present exemplary embodiment, the second correction operation is applied to the thin sheet transported through the transport path 37. However, for example, the third, fourth, or sixth correction operation may be applied to the thin sheet transported through the transport path 37 as long as the transport force is larger than that in the correction operation applied to the thin sheet transported only through the transport path 48.

Furthermore, in the aforementioned present exemplary embodiment, the third correction operation is applied to the thick sheet. However, for example, the fourth, fifth, or sixth correction operation may be applied to the thick sheet as long as the transport force is larger than that in the correction operation applied to the thin sheet transported through the transport path 37.

In the aforementioned exemplary embodiment, the control is aimed at three types of sheets, that is, the thin sheet transported only through the transport path 48, the thin sheet transported through the transport path 37, and the thick sheet. However, the control may be aimed at two types of sheets, or four or more than four types of sheets.

One of the conditions affecting the transport force required to transport the recording medium P from the transport mechanism 70 to the position where the leading end of the recording medium P abuts the abutting members 62 is, as mentioned before, the thickness (basis weight) of the recording medium P. The stiffness of the recording medium P changes in accordance with the thickness (basis weight) of the recording medium P. When the thickness (basis weight) is large, the transport force required to transport the recording medium P from the transport mechanism 70 to the position where the leading end of the recording medium P abuts the abutting members 62 increases.

Another condition affecting the transport force is, as mentioned before, the transport path through which the recording medium P is transported. The transport resistance against the recording medium P changes in accordance with the transport path through which the recording medium P is transported. When the transport resistance against the recording medium P is large, the transport force required to transport the recording medium P from the transport mechanism 70 to the position where the leading end of the recording medium P abuts the abutting members 62 increases.

Another condition affecting the transport force is, as mentioned before, the length of the recording medium P in the transport direction. The transport resistance against the recording medium P changes in accordance with the length of the recording medium P in the transport direction. When the transport resistance against the recording medium P is large, the transport force required to transport the recording medium P from the transport mechanism 70 to the position where the leading end of the recording medium P abuts the abutting members 62 increases.

In the present exemplary embodiment, it is sufficient that the correction operation be selected in accordance with the required transport force that is determined in accordance with the above-described conditions. That is, it is sufficient that the correction operation, in which a large transport force is used, be selected for the recording medium P, for which a large transport force is required.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. For example, the plural foregoing variants may be appropriately combined. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device that transports a transport object having a leading end, the device comprising:

an abutting member that abuts the leading end of the transport object; and a plurality of transport members disposed upstream of the abutting member in a transport direction, the plurality of transport members transporting the transport object to the abutting member; and a controller that controls the abutting member and the plurality of transport members, wherein the plurality of transport members include:

a first transport member and a second transport member, the second transport member being disposed downstream of the first transport member in the transport direction, and the first transport member and the second transport member each being configured to separately move between a contact position and a separated position, wherein the transport object is a first transport object having a leading end or a second transport object having a leading end and surfaces, wherein the controller causes at least one of the plurality of transport members to transport the first transport object and cause the leading end of the first transport object to abut the abutting member, wherein, when transporting the transport object from the plurality of transport members to a position where the transport object abuts the abutting member, the controller causes the plurality of transport members to apply a larger transport force to the second transport object than a transport force applied to the first transport object, and wherein, when the second transport object is transported, a larger number of the plurality of transport members are activated than a number of the plurality of transport members activated when the first transport object is transported.

2. The transport device according to claim 1, wherein the second transport object is thicker than the first transport object.

3. The transport device according to claim 1, wherein the second transport object is longer than the first transport object.

4. The transport device according to claim 1, wherein the plurality of transport members further include:

a third transport member disposed downstream of the second transport member in the transport direction, wherein, when the first transport object is transported, the controller causes the second transport member to cause the leading end of the first transport object to abut the abutting member, and wherein, when the second transport object is transported, the controller causes the first transport member and the second transport member to transport the second transport object and cause the leading end of the second transport object to abut the abutting member.

5. The transport device according to claim 4, wherein the controller causes the third transport member to contact one of the surfaces of the second transport object so as to transport the second transport object and cause the leading end of the second transport object to abut the abutting member.

6. An image forming apparatus comprising:

the transport device according to claim 1; and an image forming section that forms an image on a recording medium transported by the transport device.

7. A transport device that transports a transport object having a leading end, the device comprising:

an abutting member that abuts the leading end of the transport object; and a plurality of transport members disposed upstream of the abutting member in a transport direction, the plurality of transport members transporting the transport object to the abutting member; and a controller that controls the abutting member and the plurality of transport members, wherein the transport object is a first transport object or a second transport object, wherein, when transporting the transport object from the plurality of transport members to a position where the leading end of the transport object abuts the abutting member, the controller causes the plurality of transport members to apply a larger transport force to the second transport object than a transport force applied to the first transport object, and wherein the plurality of transport members comprises:

a first transport member; and a second transport member, wherein the controller causes the first transport member to transport the second transport object to a position where the second transport object abuts the abutting member, and wherein the controller causes the second transport member to transport the first transport object to a position where the first transport object abuts the abutting member, the second transport member being disposed downstream of the first transport member in the transport direction, a coefficient of friction of the second transport member against the transport object being lower than a coefficient of friction of the first transport member against the transport object, the first transport member and the second transport member each being configured to separately move between a contact position and a separated position.

8. An image forming apparatus comprising:

the transport device according to claim 7; and an image forming section that forms an image on a recording medium transported by the transport device.

* * * * *